US006269936B1

(12) United States Patent
Schnutt et al.

(10) Patent No.: US 6,269,936 B1
(45) Date of Patent: Aug. 7, 2001

(54) INSTALLATION FOR THE TRANSPORT OF HELICAL-SHAPED WOUND SPRINGS

(75) Inventors: Josef Schnutt, Gaissau (AT); Roland Keller, Wittenbach (CH)

(73) Assignee: Spuhl AG St. Gallen, Wittenbach (CH)

( * ) Notice: Subject to any disclaimer, the term of this patent is extended or adjusted under 35 U.S.C. 154(b) by 0 days.

(21) Appl. No.: 09/433,273

(22) Filed: Nov. 3, 1999

(30) Foreign Application Priority Data

Dec. 24, 1998 (CH) ..... 02560/98

(51) Int. Cl.[7] ..... B65G 47/86

(52) U.S. Cl. ..... 198/470.1; 198/474.1; 198/476.1

(58) Field of Search ..... 198/470.1, 474.1, 198/476.1

(56) References Cited

U.S. PATENT DOCUMENTS 4,968,081 * 11/1990 Beight et al. ..... 294/104
5,169,139 * 12/1992 Stauber et al. ..... 198/470.1
5,311,976 * 5/1994 Backman ..... 198/470.1
5,388,820 * 2/1995 Eberle et al. ..... 198/470.1
5,743,377 * 4/1998 Kronseder ..... 198/803.9

* cited by examiner

*Primary Examiner*—Douglas Hess
(74) *Attorney, Agent, or Firm*—Wood, Herron & Evans, LLP

(57) ABSTRACT

The installation for the transport of helical-shaped wound springs comprises a star turret with gripper hands. The gripper hands consist of two jaws of which at least one is pivotable and is pressable with the force of a tension spring against the second. The spring produced on the winding machine is pressed by the insertion means into the gripper hand and is held firmly by this by the force of the tension spring during the transport and during the heat treatment. For the transfer of the spring to a transport device insertion jaws are pivotably connected to the transport means and push the spring out of the gripper hand, overcoming at least a part of the tension force of the tension spring, into a receiver on the transport device.

18 Claims, 5 Drawing Sheets

INSTALLATION FOR THE TRANSPORT OF HELICAL-SHAPED WOUND SPRINGS

BACKGROUND OF THE INVENTION

The subject-matter of the invention is an installation for the transport of helical-shaped wound springs, according to the introductory part of patent claim 1.

With the manufacture of high quality springs for mattresses, a heat treatment is carried out which effects a permanently constant spring constant. The heat treatment may be effected directly after the production, i.e. after the winding of the spring or in a separate working procedure. With modem high performance machines the manufacturing process is carried out as uninterrupted as possible, i.e. the springs after the winding are immediately led to a heat treatment and from here go directly to further processing, e.g. to a fully automatically functioning spring interior assembly machine. With the previously known installations the springs after winding are grasped with drivable, exactly controlled holding means and are led from processing station to processing station. The mechanical and electrical control expense of such holding means is quite large and its maintenance is expensive.

BRIEF SUMMARY OF THE INVENTION

The object of the present invention thus lies in providing an installation which takes over the springs wound on the winding machine, can lead them to a heat treatment station and from here to a transport means and which makes do without actively driven and controlled holding means.

This object is achieved by an installation for the transport of helical-shaped wound springs according to the features of patent claim 1.

Advantageous formations of the invention are defined in the dependent claims.

It possible with spring loaded jaws arranged in pairs and with a simple insertion device to take over the springs from the winding machine, to introduce them into the heat treatment station and subsequently with a scraper to introduce them from the holding means into the transport device. For the holding means neither mechanical drives nor control means are required. The retention of the springs is effected by the gripping force of the jaws cooperating in pairs. The star turret carrying the holding means can as a result be manufactured extremely inexpensively, since no clamping drive elements need be guided through its rotational axle and through the arms. The drives of the star turret, of the insertion device and of the scraper may be connected synchronously to one another. As a result a complicated control is not necessary.

BRIEF DESCRIPTION OF THE DRAWINGS

By way of an illustrated embodiment example the method according to the invention is explained in more detail. There are shown.

DETAILED DESCRIPTION OF THE INVENTION

Figure 1:
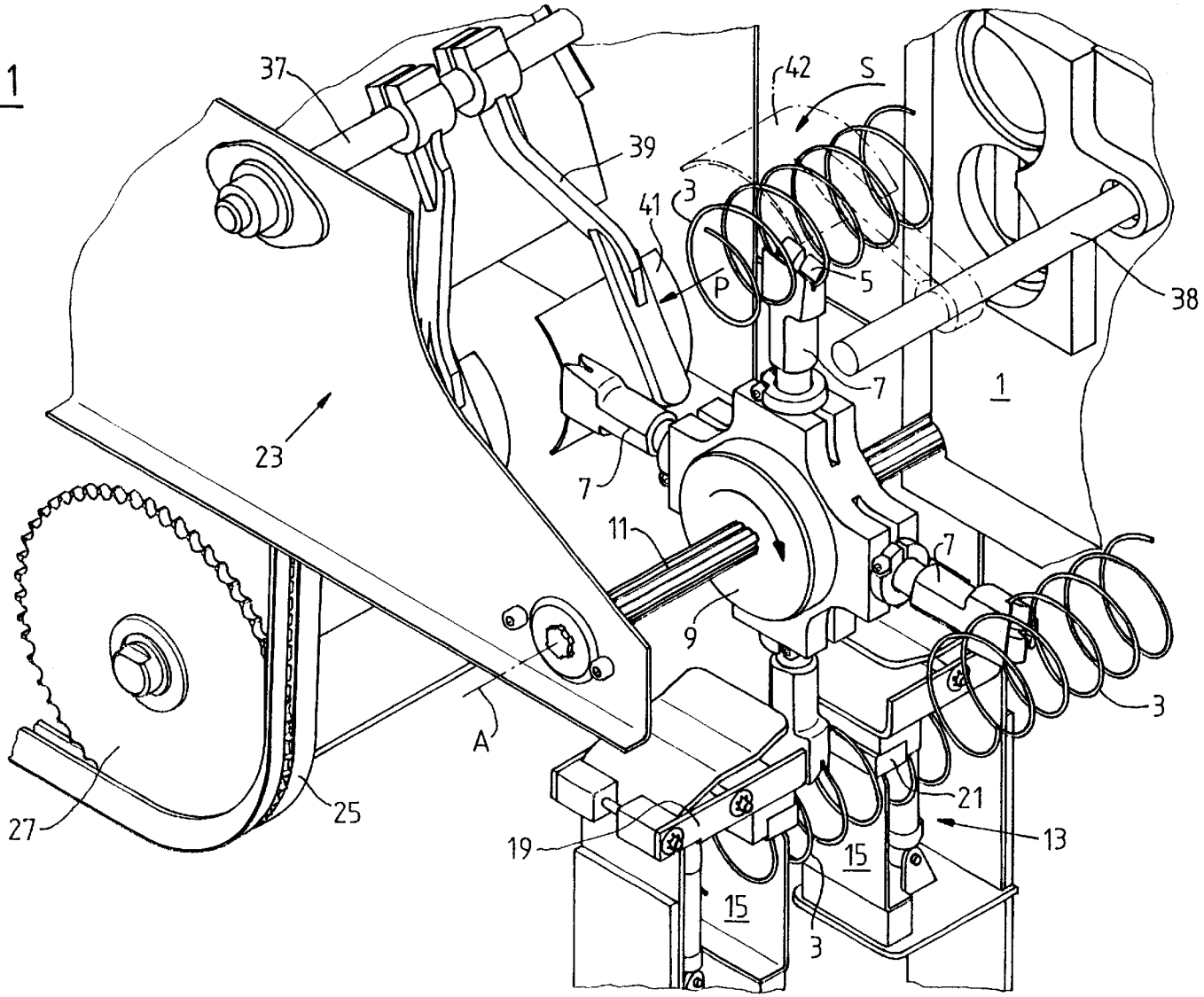
FIG. 1 a perspective part representation of the installation.

In the representation according to FIG. 1 on the right side a spring winding machine is indicated with the reference numeral 1, as is known from the state of the art, and is therefore not described in any detail. The spring 3 wound of wire leaves the spring winding machine 1 at the end face in the direction of the arrow P. After is completion but before the severing of the endlessly supplied wire, the produced spring 3 is pressed downwards in the direction of arrow S with an advance means 42 indicated dot-dashed, for example with a linearly or pivotably driven half shell whose radius corresponds roughly to the radius of the spring 3. The represented advance means 42 is pivotable with the drivable shaft 38. At the same time a central winding glides between the V-shaped formed claw 5 of a gripper hand 7. The gripper hand 7 is part of for example a four armed star turret 9 which is rotatably mounted on a shaft 11 in a stepped manner about the axis A. The shaft 11 may be mounted at the end face in the spring winding machine 1 and also be driven directly by the drive of this machine. During the accommodation of the spring 3 after its manufacture, the gripper hand 7 taking over the spring 3, as is shown in FIG. 1, is directed vertically upwards.

Diagonally opposite the location where the spring 3 leaves the spring winding machine 1 formed helical-shaped, there is formed a heat treatment station 13. This comprises for example two distanced plate-like vertically lying supports 15 which are arranged perpendicularly to the rotational axis A and at a distance thereto. The supports 15 above comprise essentially horizontally lying contact surfaces or contact edges 17 onto which the spring 3 comes into contact with two windings when it is transported about two cycles at 90 degrees of angle by way of the star turret 9. Over the two supports 15 electrodes 21 are fastened on pivotable arms 19. The two electrodes 21 are connected to an alternating current source (not shown). The pivotable arms 19 may also be pivoted into the position shown in FIGS. 1 and 6 by way of drive means which likewise are not shown, and pressed onto the spring 3 which bears on the contact surfaces 17 of the supports 15. For raising the spring 3 the arms may be pivoted into the vertical and thus get out of the conveying region of the spring 3 on the star turret 9.

Alternatively one of the supports 15 and an electrode 21 may be arranged turned around by 180°.

Figure 2:
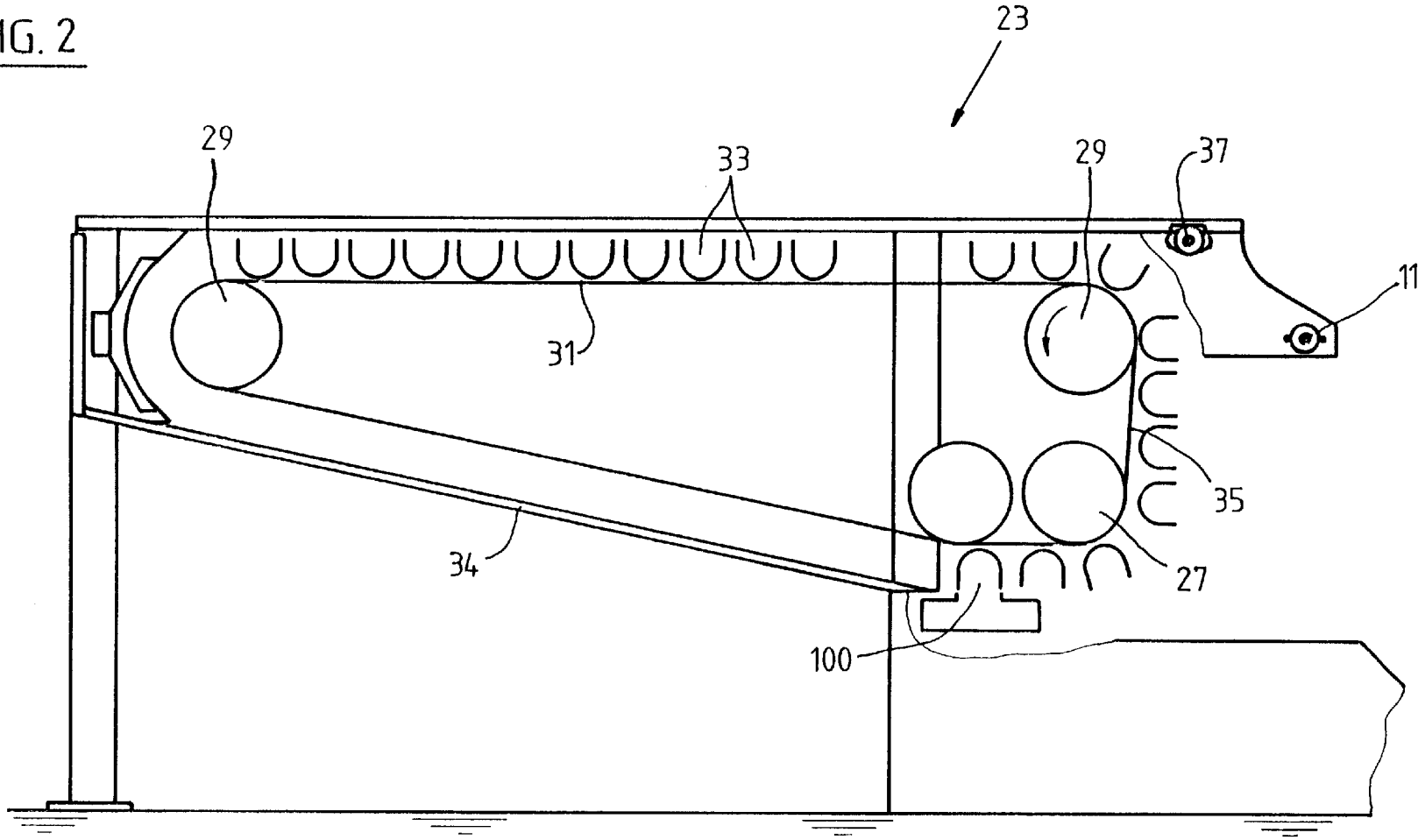
FIG. 2 a schematic lateral view of the transport device without the prior mounted star turret, FIG. 3 a section detailed view of a holding hand, FIG. 4 a section detailed view of a further formation of a holding hand, FIG. 5 a detailed view of a further holding hand in a perspective representation, FIG. 6 a cross section through the spring in the heat treatment station.

On the left side in FIG. 1 the start of the transport device 23 is viewable, this comprising a circumferential endless transport means 25 which for example may be a chain or a toothed belt. The transport means 25 is carried by transport wheels of which in FIG. 1 only that with the reference numeral 27 can be seen. The two main transport wheels 29 between which the upper belt face of the transport means 25 lies, are shown schematically in FIG. 2. On the transport means 25, receivers 33, e.g. gridded baskets formed U-shaped in cross section are fastened. Between the transport wheel 27 and the main transport wheel 29 there lies a vertically running belt face piece 35 in which the openings of the receivers (gridded baskets) 33 are aligned towards the star turret 9. The gripper hand 7 comes to lie in front of the belt face piece 35 when it has conveyed the spring 3 from the heat treatment station 13 further by 90°. On a horizontally lying pivoting shaft 37 which can be driven by the spring winding machine 1, on arms 39 there are fastened insertion jaws 41. These may, pivoted clockwise, be led laterally past on the gripper hand 7 and at the same time may insert the spring 3 held clamped in the gripper hand 7 out of the clamping into a receiver 33.

The transport device 23 transports the springs 3 transferred to it from the gripper hand 3 in a cycled manner over the upper belt face 31 to the left (in FIG. 2) and transfers them at the position 100 to a next treatment station. So that the springs 3 loosely conveyed in the receivers 33 on the lower belt face do not fall out of the receivers 33, a guide rail 34 is arranged running parallel to the belt face.

Figure 3:
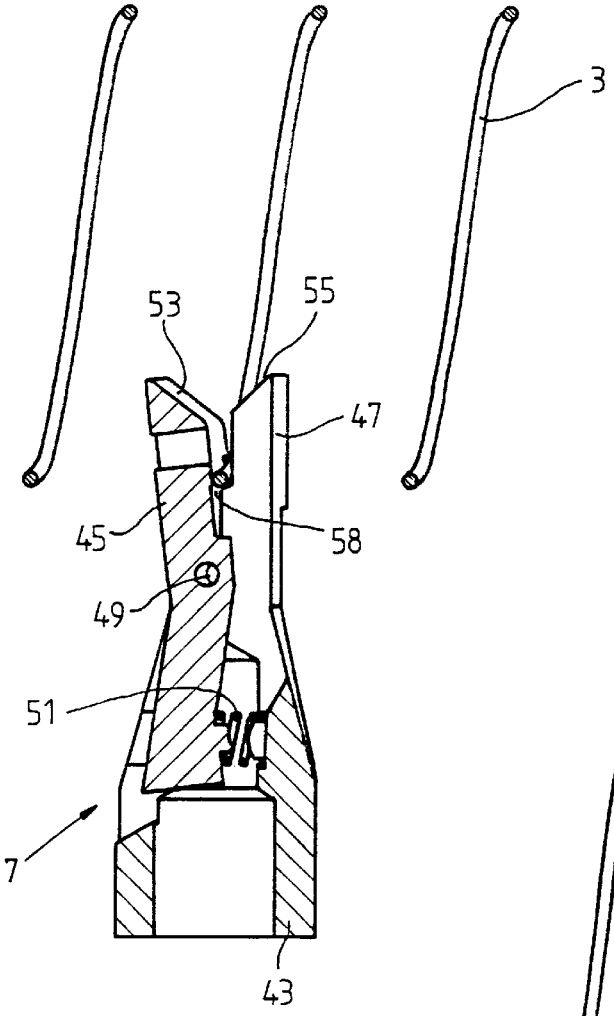

On the star turret 9 gripper hands 7 of the most varied design may be fastened. However common to all is the fact that they comprise neither an electrical nor a pneumatic or hydraulic drive in order to temporarily rigidly hold the spring 3. The holding force of the gripper hands 7 involves a pretensioned tension spring 51. In the first embodiment form according to FIG. 3 on the shank 43 which connects the gripper hand 7 to the star turret 9, there are seated two gripper jaws or claws 45 and 47. The first gripper jaw 47 may be part of the shank 43 or rigidly connected to this; the second gripper jaw 45 is pivotable about a bolt 49 which is held in the stationary first gripper jaw 47. The movable gripper jaw 45 is formed as a two-armed lever whose lower end bears with the helical spring 51 which is held tensioned between the movable gripper jaw 45 and the stationary gripper jaw 47. The upper ends of the gripper jaws 45, 47 together with their oblique end faces 53, 55 form a V-shaped run-in for the wire of the spring 3.

Figure 4:
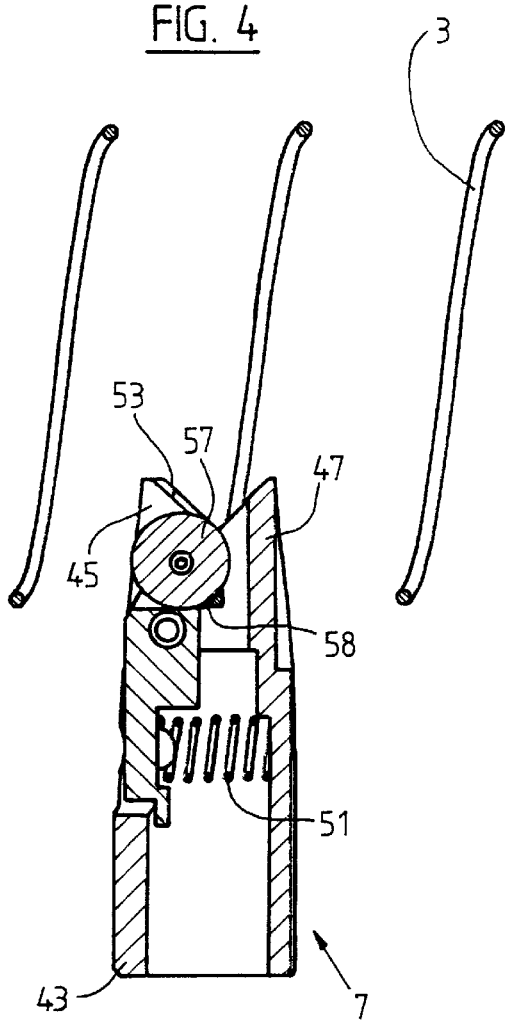

In the formation of the gripper hand 7 according to FIG. 4, on the movable gripper jaw 45 a roller 57 is rotatably mounted. The periphery of the roller 57 lies in the extension of the end face 53 of the gripper jaw 45. It favors the introduction and the moving out of the spring wire, without by way of this the holding force being compromised.

On one of the two gripper jaws 45, 47 at a distance below the end face 53, 55 there is formed a recess or notch 58. In this notch there lies the spring when it is inserted into the gripper hand 7. The notch 58 additionally favors the retention of the spring 3.

Figure 5:
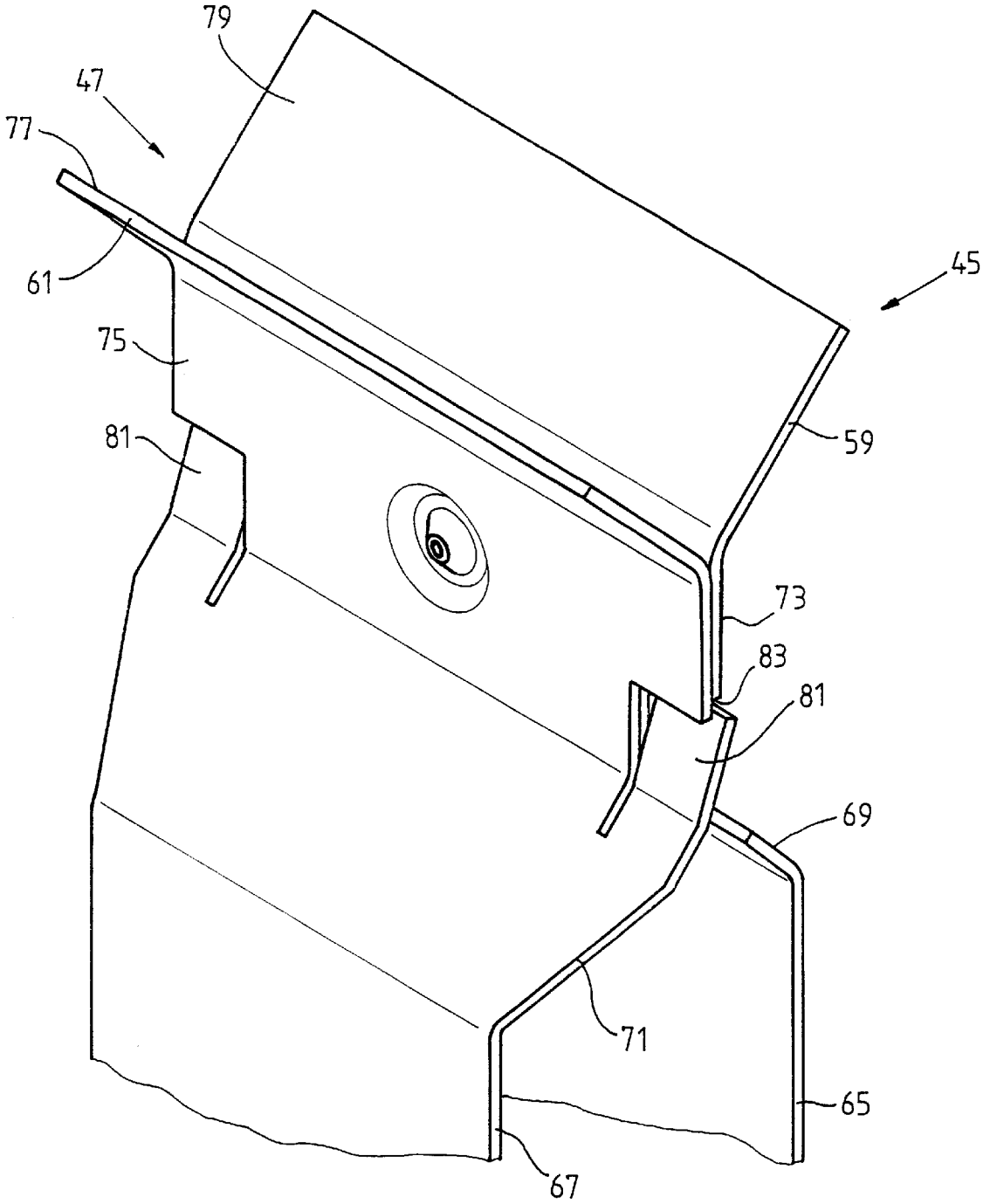
Figure 6:
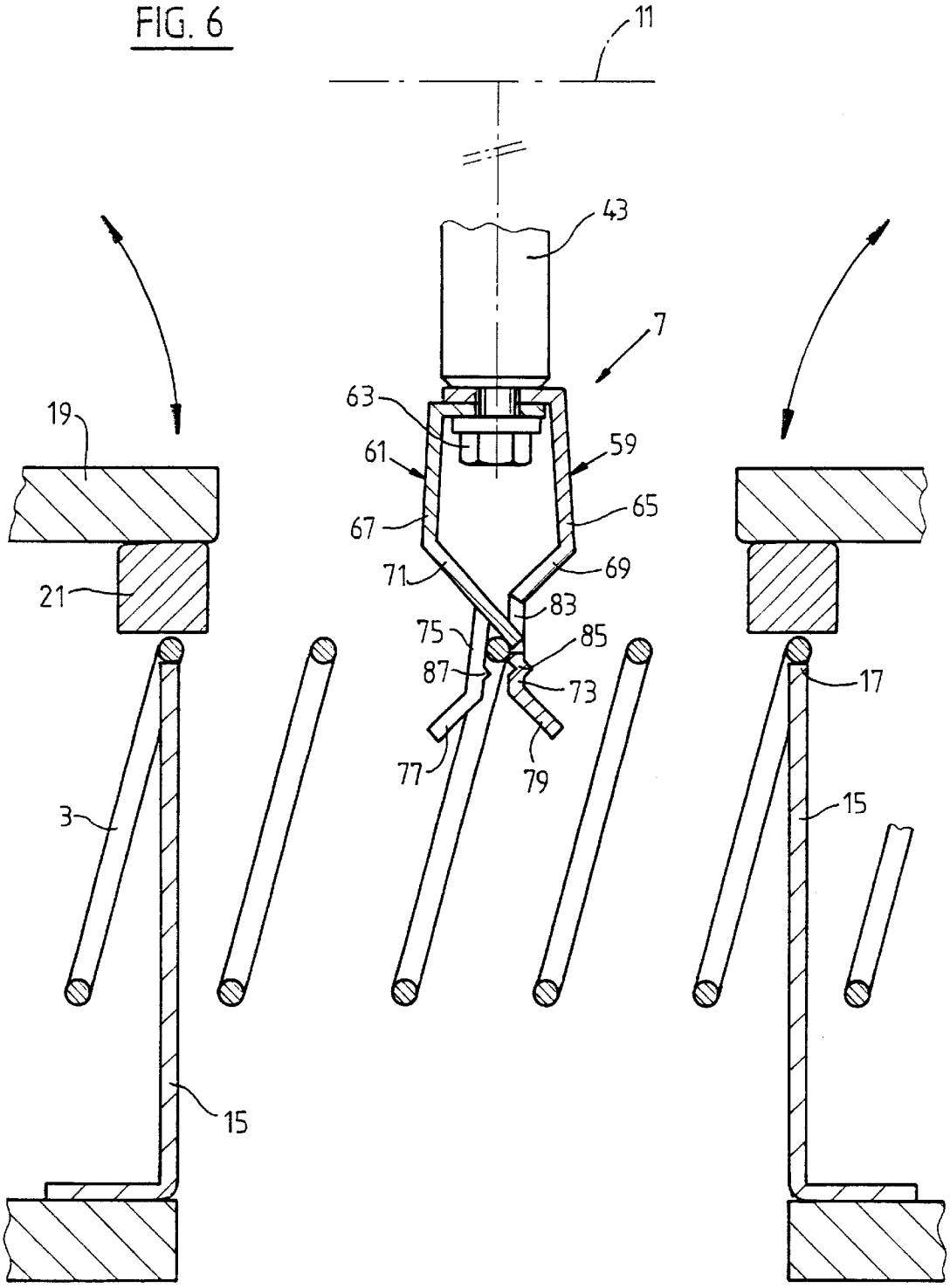

In the formation of the gripper hand according to the FIGS. 5 and 6 the latter likewise consists of two gripper jaws or claws 45, 47 of metal plates 59 and 61 folded several times, which are fastened on the shank 43 with a screw 63. The two gripper jaws 45, 47 comprise base arms 65, 67 which in the untensioned condition run essentially parallel to one another. Onto the base arms 65, 67 there connects middle arms 69 and 71 which approach in a V-shaped manner in order then to blend into two parallel running clamping sections 73 and 75 which in the untensioned condition lie on one another or are arranged to one another at a very slight distance. Onto the two clamping sections 73 and 75 there connects V-shaped run-in sections 77 and 79 running in an expanding manner. On the middle arm 69 there are formed tabs 81 laterally cut out from this and protruding in the region of the section 73. In order not to abut on the clamping section 75 this in the region in which the tabs 81 come to bear comprises recesses 83.

In the clamping section 73 an outwardly directed bulge 85 and in the clamping section 75 an inwardly directed bulge 87 may be pressed in and specifically in a manner such that the inwardly pressed bulge 87 engages into the bulge 85 from behind when the two gripper jaws 45, 47 in the untensioned condition with the two clamping sections 73, 75 lie on one another.

In the following, the functioning manner of the installation for the transport of helical-shaped wound springs 3 is briefly explained.

The spring 3 wound in the spring winding machine 1 winds in the direction of the arrow P out of the end face of the machine 1 and comes to a stop at a short distance above the gripper hand 7 lying thereunder. Before the severing of the spring wire at the spring winding machine 1 the spring 3 with the insertion device, not shown, is inserted in the direction of arrow S with one of its central windings into the V-shaped gap between the two gripper jaws 45, 47 or the two metal plates 59, 61 or the arms 65, 67. With this the jaws 53, 55 or arms 65, 67 are spread and the spring 3 is held firmly by the force of the tension spring 51 or the spring tension of the metal plates 59, 61. After a rotation of the star turret by 90° the subsequent spring 3 is transferred to the subsequent gripper hand 7. After the spring 3 has passed through a rotary angle of 180° it comes to bear with the contact surfaces 17 of the support 15 in the heat treatment station 13. Whilst above such a completed spring 3 is inserted into the gripper hand 7, below the electrodes 21 pivot onto the spring 3 supported on the contact surfaces 17 and a suitable measured current may be led through the spring 3 and this may be heated to the desired degree. As soon as the desired treatment temperature has been reached the electrodes 21 pivot back (into the vertical position) and the spring 3 is transported further by the star turret 9 about 90° and then lies in front of one of the receivers 33 on the revolving transport means 25. With the two pivotable insertion jaws 41 the spring 3 is released out of the holding force of the gripper hand 7 and conveyed directly into the receiver 33. Synchronously to the next 90° rotation of the star turret 9 the transport means 25 transports further by one step in order to prepare the next receiver 33 for the spring 3 seated on the subsequent gripper hand 7.

On the insertion jaws 41 or the transport device 23 there may be attached a circular ramp on which a pivotable gripper jaw 45 ascends and by way of this is opened at least partly, so that the spring can be securely ejected.

What is claimed is:

1. An installation for the transport of helical-shaped wound springs from a spring winding device to a heat treatment station and subsequently to a transport means, comprising a star turret rotatably driven intermittently about a rotational axis, with a number of shanks which are directed radially outwards from the star turret each of said shanks terminating in a gripper hand adapted to hold a spring, wherein the gripper hand has two jaws or metal plates of which at least one is mounted about a pivoting axis extending perpendicular to the rotational axis.

2. An installation according to claim 1, wherein the end faces of the two cooperating jaws or metal plates form a V-shaped catch surface.

3. An installation according to one of the claims 1 or 2, wherein one of the two jaws is rigidly connected to the shank and the second is pivotably linked on the first and is in connection with the other with a helical spring.

4. An installation according to one of the claims 1 to 3, wherein on one of the two gripper jaws a roller is rotatably fastened, whose periphery lies essentially in the end face of the gripper jaw.

5. An installation according to one of the claims 1 to 4, wherein at a distance below the end face on the gripper jaw there is formed a recess or notch which is envisaged for holding back one of said wound springs.

6. An installation according to one of the claims 1 or 2, wherein the metal plates consist of multiple bent spring steel plates whose central clamping sections lie parallel to one another, wherein on one of the spring steel plates there is formed at least one tab protruding into the region of the other spring steel plate.

7. An installation according to one of the claims 1 to 6, wherein radially above the star turret there is arranged a shell-shaped insertion device for inserting the spring produced on the spring winding machine between the jaws or metal plates and here is provided with a drive.

8. An installation according to one of the claims 1 to 7, wherein on the entrance side of the transport installation there is formed at least one insertion jaw for pushing the spring out of the clamping of the gripper hand and for inserting into a receiver on the transport means.

9. An installation according to claim 8, further comprising a transport means having a multitude of receivers for receiving said wound springs wherein the receivers are fastened on a revolving transport means.

10. An installation according to claim 9, wherein on the at least one insertion jaw or on the transport means there is arranged a wedge-shaped ramp, on which the gripper hand ascends and the one gripper jaw is opened.

11. An installation for the transport of helical-shaped wound springs from a spring winding device to a heat treatment station and subsequently to a transport means, comprising a star turret rotatably driven intermittently about a rotational axis, with a number of shanks which are directed radially outwards from the star turret, each of said shanks having a shank axis and terminating in a gripper hand adapted to hold a spring, said gripper hand being secured to said shank with a fastener having an axis parallel said shank axis.

12. The installation of claim 11 wherein said gripper hand has a first jaw rigidly connected to the shank and a second jaw pivotal about an axis extending perpendicular to the rotational axis.

13. The installation of claim 12 further comprising a helical spring tensioned between a lower end of said second jaw and said first jaw.

14. The installation of claim 11 further comprising a roller rotatably mounted on at least one of said jaws, said roller being adapted to contact said spring.

15. An installation for the transport of helical-shaped wound springs from a spring winding device to a heat treatment station and subsequently to a transport means, comprising a star turret rotatably driven intermittently about a rotational axis, with a number of shanks which are directed radially outwards from the star turret, and a pair of metal plates fastened to an end portion of each of said shanks, each of said metal plates having a clamping section adapted to receive and retain one of said springs, wherein said clamping section of one of said metal plates has an inwardly pressed bulge and one of said metal plates has an outwardly directed bulge, said bulges being adapted to engage one another when said metal plates are in an untensioned condition.

16. The installation of claim 15 at least one of said metal plates has tabs formed therein.

17. The installation of claim 15 wherein said metal plates are secured to said shank with a screw.

18. An installation for the transport of helical-shaped wound springs from a spring winding device to a heat treatment station and subsequently to a transport means, comprising a star turret rotatably driven intermittently about a rotational axis, with a number of shanks which are directed radially outwards from the star turret, and a pair of jaws fastened to each of said shanks, at least one of said jaws having a roller secured thereto, said roller being adapted to contact one of said springs.

* * * * *